US006453776B1

(12) United States Patent
Beattie et al.

(10) Patent No.: US 6,453,776 B1
(45) Date of Patent: Sep. 24, 2002

(54) SEPARABLE LOADBREAK CONNECTOR FLASHOVER INHIBITING CUFF VENTING TOOL

(75) Inventors: Jay Earle Beattie, Indian Head; Walter David Skoropad, Regina, both of (CA)

(73) Assignee: Saskatchewan Power Corporation (CA)

( * ) Notice: Subject to any disclaimer, the term of this patent is extended or adjusted under 35 U.S.C. 154(b) by 0 days.

(21) Appl. No.: 09/805,031

(22) Filed: Mar. 14, 2001

(51) Int. Cl.[7] ..... B25B 23/16

(52) U.S. Cl. ..... 81/53.1; 294/19.1

(58) Field of Search ..... 81/53.1, 53.11; 294/19.1, 99.1

(56) References Cited

U.S. PATENT DOCUMENTS

| | | | | |
|---|---|---|---|---|
| 3,600,784 A | | 8/1971 | Propst et al. | |
| 3,788,691 A | * | 1/1974 | McMullin | 81/53.1 X |
| 3,871,056 A | | 3/1975 | Lyons et al. | |
| 3,962,770 A | | 6/1976 | Dooley et al. | |
| 4,483,058 A | | 11/1984 | Clutter et al. | |
| 4,525,006 A | * | 6/1985 | Nowak et al. | 294/19.1 |
| 4,745,680 A | | 5/1988 | Williams et al. | |
| 4,965,930 A | * | 10/1990 | Wnukowski | 81/53.1 X |
| 5,216,801 A | | 6/1993 | Knapp | |
| 5,379,666 A | * | 1/1995 | Held | 81/53.1 |
| 5,394,313 A | * | 2/1995 | Dezelan et al. | 81/53.1 X |
| 5,655,921 A | | 8/1997 | Makal et al. | |
| 5,846,093 A | | 12/1998 | Muench, Jr. et al. | |
| 5,857,862 A | | 1/1999 | Muench et al. | |
| 5,957,712 A | | 9/1999 | Stepniak | |
| 6,075,209 A | | 6/2000 | Luzzi | |

FOREIGN PATENT DOCUMENTS

CA 2298193 10/2000

OTHER PUBLICATIONS

Jay Beattie, "RUD Elbow Flashovers", Report NO. 00–290, SaskPower T&D Technical Support Services High Voltage Laboratory Report, Regina, Saskatchewan, Canada, Mar. 2, 2000.

Elastimold System Planning Guide; Apr., 1994 catalogue No. SP2000 publication of Elastimold unit of Eagle Industries Inc., Hackettstown, NJ.

"Loadbreak Designs with Low Current Switching Capability", Test Report No. 191–17–7219, Dec., 16, 1997; Elastimold unit of Thomas & Betts Corporation, Hackettstown, NJ.

(List continued on next page.)

*Primary Examiner*—D. S. Meislin
(74) *Attorney, Agent, or Firm*—Oyen Wiggs Green & Mutala

(57) ABSTRACT

A separable loadbreak connector cuff venting tool having a handle formed of an electrical insulator material. An electrically insulating head is fixed on the handle's forward end. Two or more wedges, sized and shaped for slidable insertion within the cuff, are formed on the head. A rearwardly directed force applied along the handle's longitudinal axis gradually slides the wedges within the cuff, thereby venting partial vacua from within the cuff to the surrounding atmosphere and reducing the likelihood of flashover. Optionally, a clamp may be provided on a rearward portion of the handle for use in clamping the tool's handle to a hotstick handle. As another option, a pivot fulcrum may be provided on the rearward portion of the tool's handle for use in pivotally levering the tool's handle away from the hotstick handle. The tool's head, clamp and pivot fulcrum extend transversely away from the cuff venting tool, in the same direction.

10 Claims, 7 Drawing Sheets

OTHER PUBLICATIONS

"Relieve The Pressure . . . Switch With Confindence" Bulletin No. FL0298A of Elastimold unit of Thomas & Betts Corporation, Hackettstown, NJ.

"Upgrading Your 25KV System to Improve Switching" Bulletin No. B–0698A of Elastimold unit of Thomas & Betts Corporation, Hackettstown, NJ.

Safe–T–Ring Test Reports comprising 1998–1999 testing results reported by Chardon Electrical Components division of Hubbell Power Systems, Inc. Greenville, TN.

Safe–T–Ring Comparative Analysis Tech Data report of Chardon Electrical Components Division of Hubbell Power Systems, Inc. Greenville, TN.

* cited by examiner

SEPARABLE LOADBREAK CONNECTOR FLASHOVER INHIBITING CUFF VENTING TOOL

TECHNICAL FIELD

This invention pertains to a tool for venting the cuff area of a separable loadbreak connector to reduce the likelihood of flashover upon separation of the connector's male/female components

BACKGROUND

High voltage cables to padmount transformers, reactors, and other underground power distribution apparatus make use of several types of removable connectors referred to as "separable insulated connectors". The requirements and constructional dimensions of such connectors are specified in ANSI/IEEE Standard 386, Separable Insulated Connector Systems for Power Distribution Systems Above 600 V. Connectors that can be removed while the apparatus remains energized are referred to as "loadbreak connectors". The advantage of a load-break connector is that it permits minimizing the number of customers who will be without power while maintenance is in progress by selectively de-energizing individual pieces of apparatus rather than a whole section of line.

FIG. 1 depicts one type of loadbreak connector 10 for electrically conductively coupling cable 12 to apparatus 14. Connector 10 consists of female elbow portion 16, male bushing insert 18 and bushing well 20. As is well known to persons skilled in the art, other types of loadbreak connectors (not shown) may utilize a non-field-replaceable integral bushing instead of a bushing insert; or, a female component such as a parking stand and feedthrough mated to a male elbow; or, an alternative male type cuffed component such as a cap; or, alternative male-female tee connector components. In all cases, the male component has a cuff such as cuff 44 shown in FIG. 1. Elbow portion 16 includes a grounding wire 21, an operating eye 22, and a test point 24 having a removable cap 26. A compression lug 28 within elbow portion 16 is mechanically and electrically conductively coupled between cable 12 and probe 30. Bushing well 20 is mounted on apparatus 14 such that connection pin 32 extends within tapered cavity 34 of bushing well 20. A mating tapered portion 36 of bushing insert 18 having a threaded aperture 38 is fitted within cavity 34, and connection pin 32 is threaded into aperture 38. The opposed tapered portion 40 of bushing insert 18 is fitted within mating tapered aperture 42 in elbow portion 16 and sealed by fitting cuff 44 over shoulder 41 of bushing insert 18, such that probe 30 makes electrical contact with connection pin 32 through aperture 38 and other internal connecting mechanisms (not shown). In operation, internal portions of loadbreak connector 10 including compression lug 28, probe 30, tapered portions 36 and 40, aperture 38 and pin 32 are at high voltage relative to the external housing or shield portions 46, 48 of loadbreak connector 10, which remain at ground potential.

Loadbreak connector 10 is conventionally opened (by a qualified, trained operator) by coupling an insulated tool known as a "hotstick" (sometimes alternatively called a "hammer stick", "impact stick", lever stick", "universal grip-all" or "shotgun stick"), to operating eye 22 then pulling on the hotstick to separate elbow portion 16 from bushing insert 18. As elbow portion 16 begins to move away from bushing insert 18, partial vacua are created inside aperture 42 until elbow portion 16 has moved sufficiently far away from bushing insert 18 to allow such partial vacua to vent to the ambient air. Such partial vacua can be detrimental to the strength of the high voltage insulation in loadbreak connector 10. More particularly, weakening of the insulation, either directly or indirectly attributable to such partial vacua, is thought to be responsible for high voltage flashovers which sometimes occur along the operating interface comprising tapered portion 40 of bushing insert 18 and the mating tapered aperture 42 in elbow portion 16. Besides posing a safety hazard to personnel working with loadbreak connectors, flashovers can cause considerable equipment damage and consequential equipment outage time. It is accordingly desirable to eliminate or minimize these partial vacua so as to eliminate or minimize potential flashovers.

The prior art has addressed the problem of partial vacua and flashovers in a variety of ways. One approach, exemplified by U.S. Pat. No. 5,957,712 Stepniak (believed to be marketed under the trademark Elastimold™ by Thomas & Betts Corporation, Hackettstown, N.J.) has been to provide slots in the shoulder of the bushing insert to vent a cavity formed between the elbow cuff and the transition shoulder portion of the bushing insert with ambient air. According to Stepniak, this avoids a decrease in pressure within the connection region and avoids a decrease in the dielectric strength of the air therein, thus preventing flashover. Alternatively, the elbow portion of Stepniak's connector includes an insulative layer covering a portion of the probe to increase the distance between the energized electrode and ground; or, an insulative layer is provided within the elbow's aperture.

Another prior art approach, exemplified by U.S. Pat. No. 5,857,862 Muench et al. has been to provide a semi-conductive insert which includes an additional volume of air which surrounds energized portions of the connector's elbow or cap. During separation, the semi-conductive insert stretches, increasing the volume of the interior space between the elbow (or cap) and the bushing. According to Muench et al., the additional volume of air lessens the reduction in pressure during separation so that the dielectric strength of the air surrounding energized portions of the elbow (or cap) is maintained at a higher level. The increased dielectric strength of the air is said to significantly reduce the possibility of a flashover occurring during separation of the elbow (or cap) from the bushing.

Yet another prior art approach, exemplified by U.S. Pat. No. 5,846,093 Muench, Jr. et al. has been to line the elbow with an elastic insulator. When the elbow and bushing are connected, a cavity is formed there-between. A rigid member prevents the connector from stretching substantially when the elbow and bushing are disconnected. According to Muench, Jr. et al., because the connector is prevented from stretching, the air pressure in the elbow-bushing cavity remains relatively high during disconnection. The dielectric strength of the air in the cavity, which is a function of pressure, is said to also remain high, so that the possibility of flashover is substantially eliminated.

U.S. Pat. No. 5,655,921 Makal et al. addresses the flashover problem in a variety of ways. In one aspect, exposed conductive portions of the male connector are supplemented with insulated portions such that energized points on the energized connector are placed a greater distance away from the nearest ground plane on the complementary connector. The additional insulation is said to compensate for reductions in dielectric strength of the air occurring during separation of the male connector from the female connector. The bushing's semi-conductive ground shield (i.e. depicted at 46, 48 in the case of loadbreak connector 10 shown in FIG. 1) is also supplemented by an insulating sleeve, which is said to effectively remove a common ground plane to which an arc might tend during a flashover. In another aspect, a substantial airtight seal is prevented between elastomeric seals of the female connector and the probe of the male connector. The connection being thus vented, the available volume of air surrounding the energized components of the connector assembly is increased. The probe portion of the elbow is configured to prevent substantial sealing between the connector components. An annular reduced diameter recess is located between the probe's metal rod and its arc follower (i.e. the tip portion of probe 30 shown in FIG. 1) and is elongated to prevent substantially airtight sealing between the elbow and bushing during the initial stages of the loadbreak operation itself. The Makal et al. probe may alternatively be hollow and vented or include a groove disposed along its length. The Muench et al., Muench, Jr. et al. and/or Makal et al. devices are believed to be marketed under the trademarks RTE™ and/or Posi-Break™ by the Cooper Power Systems division of Cooper Industries Inc., Pittsburgh, Pa.

A still further prior art approach, believed to be marketed under the trademark Safe-T-Ring™ by the Chardon Electrical Components division of Hubbell Power Systems, Inc., Greeneville, Tenn., has been to retrofit the loadbreak connector with a ported ring encircling the cuff entry, to prevent vacuum formation within the cuff.

The aforementioned prior art approaches entail structural alteration of the loadbreak connector itself. Implementation of any such approach would require an electric utility operator to replace or retrofit existing elbows and/or bushings. The conversion process could take several years to complete. During conversion, operators would probably experience some flashover incidents, since the connectors must be opened before they can be structurally altered.

As an alternative to structurally altering the loadbreak connector itself, one may modify the apparatus (i.e. pad-mount transformer, reactor, etc.) to incorporate internal switches allowing the apparatus to be de-energized before the connectors are opened. However, addition of such switches would add significant cost to the apparatus, assuming such switches were added only to newly installed apparatus. Retrofitting in-service apparatus to include such switches would be very costly and could also take years to implement.

Some utility operators have implemented procedures whereby the line is de-energized by pulling the tap-off fuse before opening a connector. However, this defeats the purpose of a loadbreak connector, since all the customers on the tap would be without power while work was in progress. Some operators have also suggested that reheating the connector reduces the probability of a flashover. But, reheating the connector consumes time and may only apply to planned outages where several hours advance notice is given to the operator.

The present invention adopts a different approach, whereby a special tool is used to vent the cuff area between the separable male/female connector components.

SUMMARY OF INVENTION

The invention provides a separable loadbreak connector cuff venting tool having a handle formed of an electrical insulator material. An electrically insulating head is fixed on the handle's forward end. The head is sized and shaped for mating engagement with the loadbreak connector's cuff. A rearwardly directed force applied along the handle's longitudinal axis gradually slides the head into the cuff, thereby venting any partial vacuum from within the cuff to the surrounding atmosphere and reducing the likelihood of flashover.

Advantageously, a rearwardly projecting member sized and shaped for slidable insertion within the cuff is formed on the head. The member is preferably a wedge. Most preferably, two or more opposed wedges are provided. The wedges are rearwardly tapered and may have rounded rearward tips and/or rearward concave curvature.

Optionally, a clamp may be provided on a rearward portion of the handle for use in clamping the tool's handle to a hotstick handle. As another option, a pivot fulcrum may be provided on the rearward portion of the tool's handle for use in pivotally levering the tool's handle away from the hotstick handle. The tool's head, clamp and pivot fulcrum extend transversely away from the tool's handle, in the same direction.

DESCRIPTION

Figure 2:
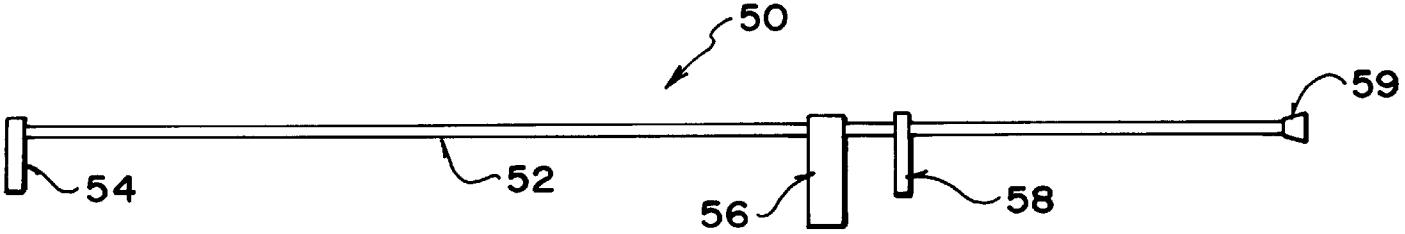
FIG. 2 is a side elevation view of a cuff venting tool in accordance with the present invention.

FIG. 2 depicts a cuff venting tool 50 constructed in accordance with the invention. Tool 50 includes an elongate rod handle 52 formed of an electrical insulator material such as foam or epoxy-filled fibreglass, or other electrical-grade insulating rod material. A head 54 formed of an electrical insulator material such as polycarbonate, polyurethane, Nylon™, polyvinyl chloride (PVC), Teflon™, epoxy, etc. is mounted on a forward (i.e. leftward, as viewed in FIG. 2) end of handle 52 such that head 54 projects transversely away from the axis of handle 52. Electrically insulating clamp 56 and pivot fulcrum 58 are mounted at spaced apart locations on a rearward (i.e. rightward, as viewed in FIG. 2) portion of handle 52 at a safe working clearance away from head 54, such that clamp 56 and pivot fulcrum 58 project transversely away from the axis of handle 52 in the same direction as head 54. Handle 52 is sufficiently long to enable an operator to maintain a safe working clearance away from loadbreak connectors and associated electrical apparatus during operation of cuff venting tool 50 as hereinafter explained. An optional protective cap 59 can be fitted over the rearward end of handle 52.

Figure 4:
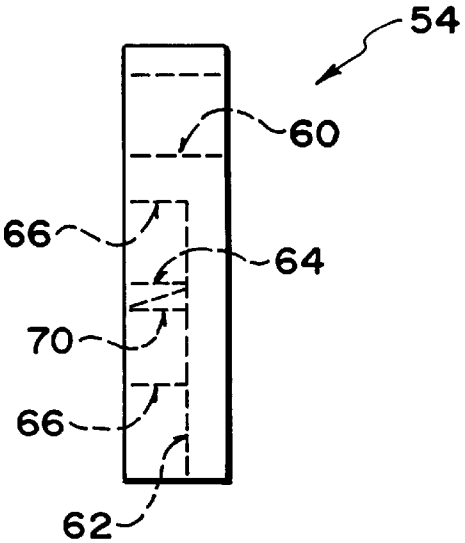
FIGS. 3, 4 and 5 are respectively front elevation, side elevation and isometric views of the head portion of the FIG. 2 cuff venting tool. The scale of FIGS. 3–5 is enlarged relative to the scale of FIG. 2, and the scale of FIG. 5 is enlarged relative to the scale of FIGS. 3–4.
Figure 3:
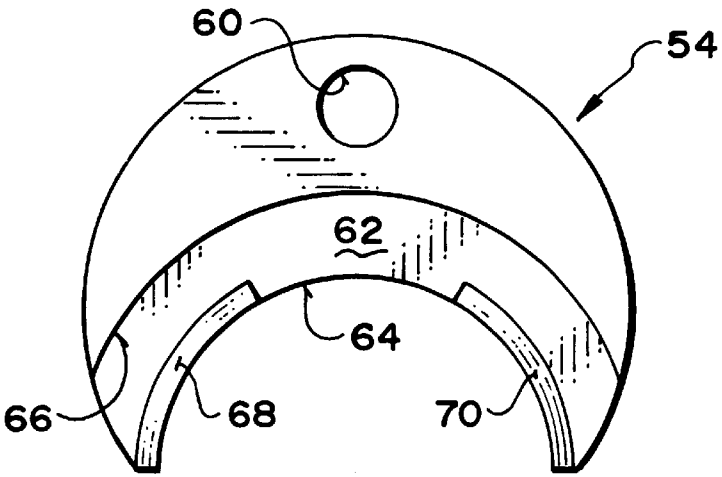
Figure 5:
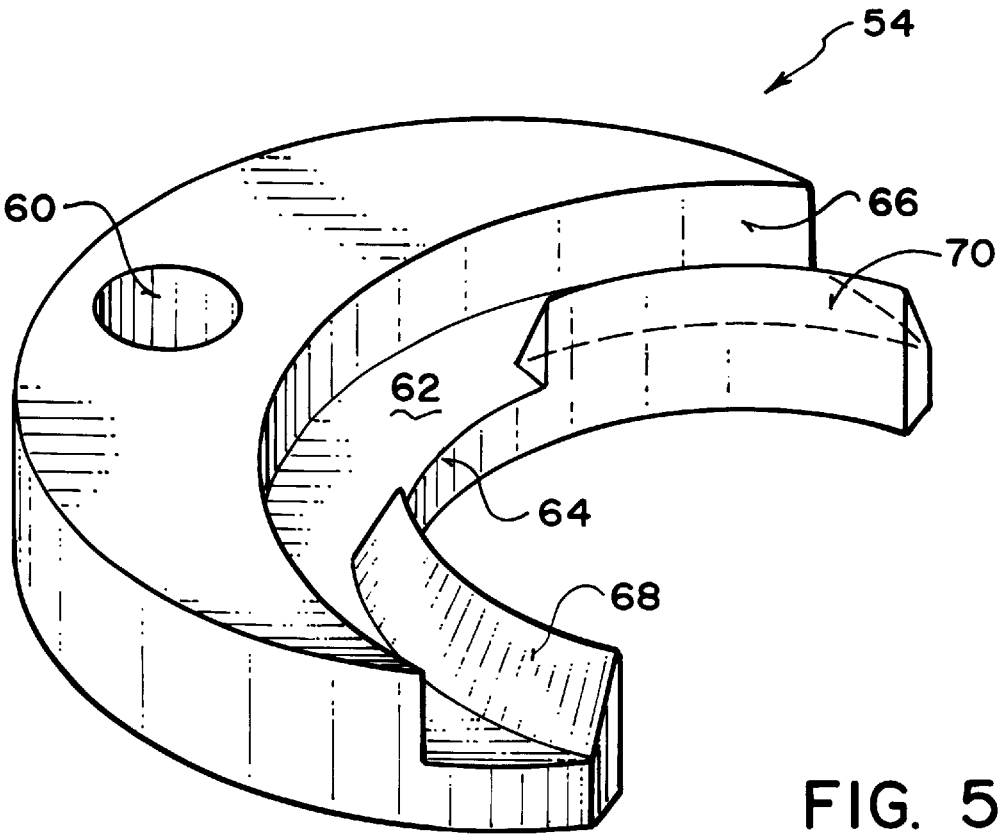

As seen in FIGS. 3, 4 and 5 head 54 has an aperture 60 within which the forward end of handle 52 is non-rotatably secured. An arcuate, forwardly recessed lip 62 having a lower circumferential edge 64 is formed in head 54. Shoulder 66 defines an upper circumferential edge of lip 62. A pair of rearwardly projecting arcuate, rearwardly tapered wedges 68, 70 are formed along opposed outward ends of edge 64.

Figure 6:
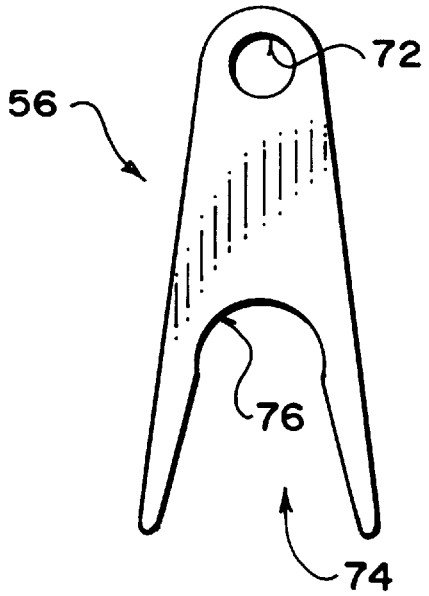
FIGS. 6 and 7 are respectively front and side elevation views of the clamp portion of the FIG. 2 cuff venting tool. The scale of FIGS. 6–7 is enlarged relative to the scale of FIG. 2.
Figure 7:
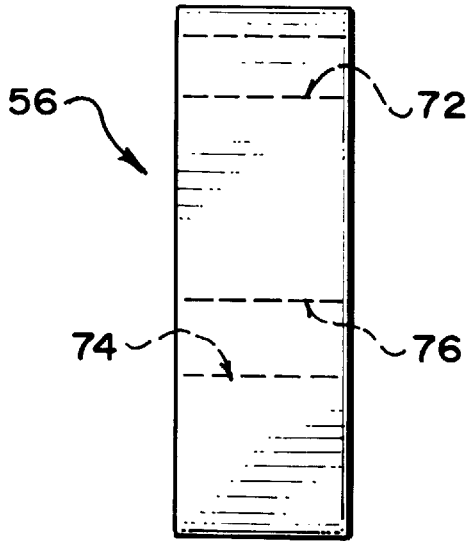

As seen in FIGS. 6 and 7, clamp 56 has an aperture 72 through which handle 52 is extended prior to non-rotatable securement of a rearward portion of handle 52 within aperture 72 at an approximate distance from head 54 as depicted in FIG. 2. Clamp 56 has an inwardly tapered, open-bottomed aperture 74 which merges into semicircular aperture 76. Aperture 76 is sized and shaped for snug snap-fit clamping engagement on a hotstick handle, as hereinafter explained.

Figure 9:
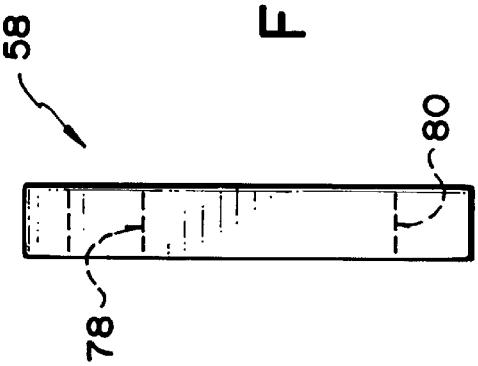
FIGS. 8 and 9 are respectively front and side elevation views of the pivot portion of the FIG. 2 cuff venting tool. The scale of FIGS. 8–9 is enlarged relative to the scale of FIG. 2.
Figure 8:
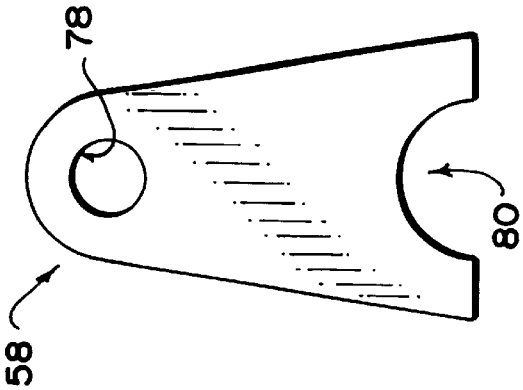

As seen in FIGS. 8 and 9, pivot fulcrum 58 has an aperture 78 through which handle 52 is extended prior to non-rotatable securement of handle 52 within aperture 78 at an interval spaced from clamp 56 by an approximate distance as depicted in FIG. 2. A semi-circular or other suitably shaped open-bottomed aperture 80 may be formed in pivot fulcrum 58. The diameter of aperture 80 is slightly larger than the diameter of a conventional hotstick handle to prevent binding of pivot fulcrum 58 on the hotstick handle during separation of cuff venting tool 50 from a hotstick as hereinafter explained.

Figure 1:
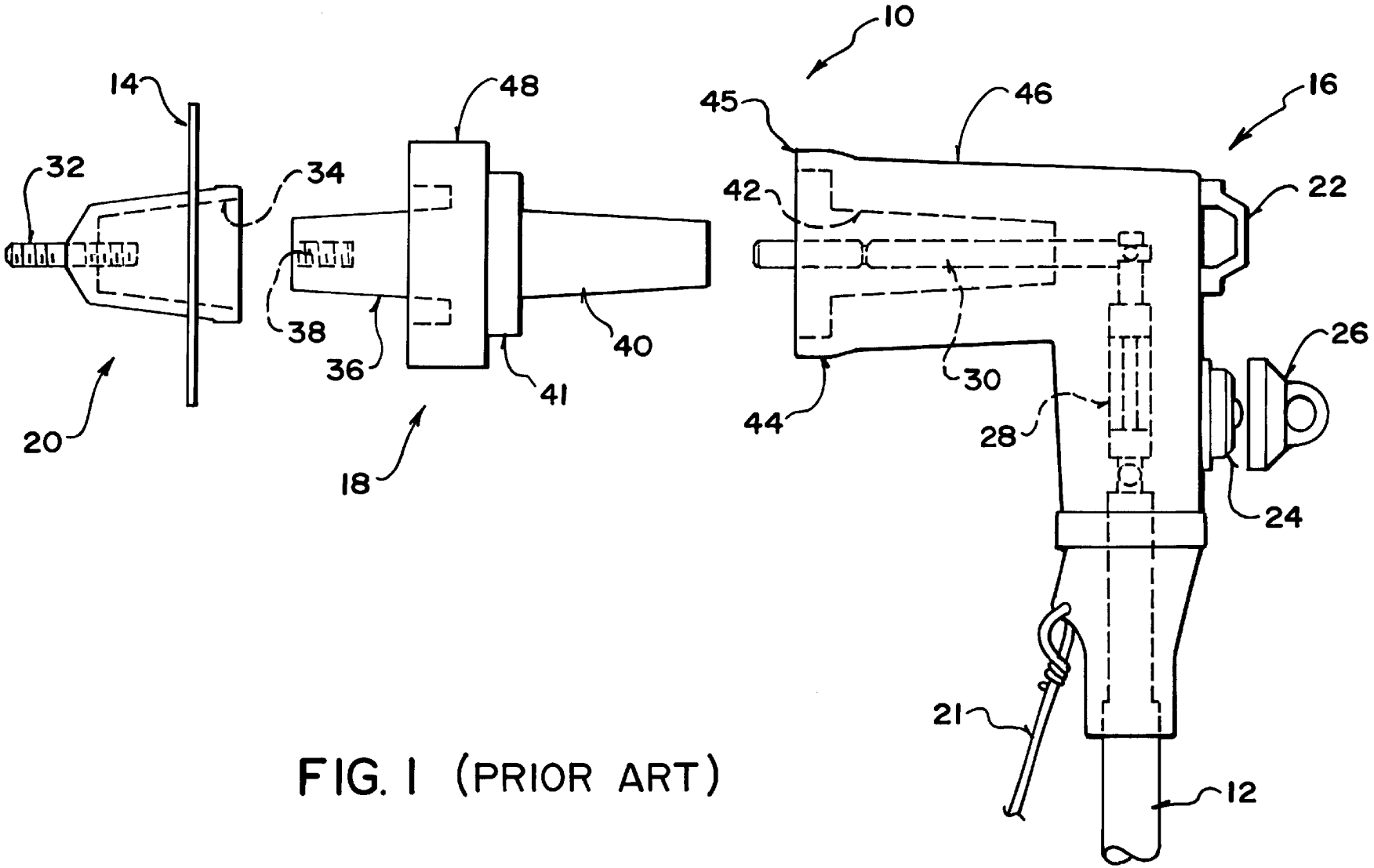
FIG. 1 (PRIOR ART)
FIG. 1 is an exploded side elevation view of a prior art loadbreak connector.
Figure 10:
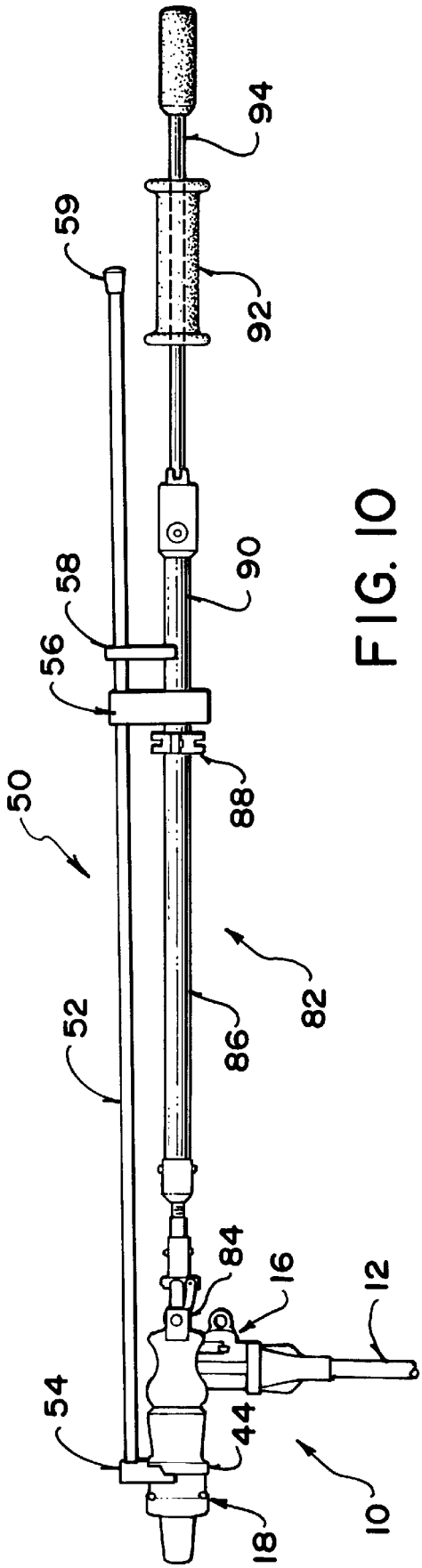
FIG. 10 is a side elevation view depicting the FIG. 2 cuff venting tool pivotally clamped to a hotstick coupled to a loadbreak connector, with the tool's head portion positioned inside the connector's cuff.

In operation, a prior art hotstick 82 (FIG. 10) is coupled to loadbreak connector 10 in well known fashion. Hotstick 82 is conventional in construction and incorporates gripping attachment mechanism 84 (for coupling to operating eye 22), insulated rod 86, slidable collar 88 (for demarcating a safe working distance from loadbreak connector 10), handhold area 90, sliding anvil 92 and metal rod 94. The operator (not shown) then grasps the rearward end of handle 52 and manipulates cuff venting tool 50 to position head 54 immediately forwardly of cuff 44 (i.e., in the case of the style of loadbreak connector illustrated in FIGS. 1 and 10, edge 64 rests against the curved outer surface of bushing insert 18 with wedges 68, 70 aligned with the entrance to aperture 42). Lip 62, edge 64, shoulder 66 and wedges 68, 70 are sized and shaped for mating engagement with adjacent portions of bushing insert 18 and cuff 44 when head 54 is positioned on loadbreak connector 10 as aforesaid and as shown in FIG. 10. The operator then pulls cuff venting tool 50 rearwardly (i.e. to the right, as viewed in FIG. 10) to gradually slide wedges 68, 70 into aperture 42, thus venting cuff 44 to the atmosphere as elbow portion 16 of loadbreak connector 10 is separated from bushing insert 18. Clamp 56 is then positioned to align aperture 74 over the hotstick's handhold area 90. Pressure is then applied to clampingly engage (i.e. snap-fit) handhold area 90 within aperture 76 of clamp portion 56. This fixes cuff venting tool 50 in position on hotstick 82, allowing the operator to let go of cuff venting tool 50 and use both hands in subsequent manipulation of hotstick 82. After successful separation of loadbreak connector 10, the operator bears down on the rearward portion of handle 52 with sufficient force to bring aperture 80 of pivot fulcrum 58 into contact with handhold area 90. Sufficient further downward levering pressure is applied to handle 52 as required to disengage clamp portion 56 from hotstick 82.

The aforementioned ANSI/IEEE Standard 386 specifies the dimensions of loadbreak connectors to enable models from different manufacturers to be used interchangeably. Accordingly, it should not be necessary to provide a variety of different shapes or sizes of head 54 to accommodate a corresponding variety of shapes and sizes of loadbreak connectors in a given voltage system. The Standard currently specifies loadbreak connector dimensions for three different voltage systems, implying that at most three different versions of head 54 are required to accommodate loadbreak connectors used in all three systems. There is some variation in shapes and sizes of conventionally available hotsticks (including impact or hammer stick, lever stick, shotgun with or without elbow puller tool, etc.), so a selection of different, interchangeable sizes of clamp 56, pivot fulcrum 58 and lengths of handle 52 can be provided to facilitate use of cuff venting tool 50 with different hotsticks. Cuff venting tool 50 can accordingly be readily configured and assembled by specifying the voltage class (thus determining the size and shape of the required head 54); and, hotstick length, style and diameter (thus determining the size and shape of the required clamp 56 and pivot fulcrum 58, and their respective positions on handle 52).

Cuff venting tool 50 provides a number of advantages over prior art approaches to the above-described problem of partial vacua and flashovers. Specifically, by inhibiting formation of partial vacua, cuff venting tool 50 addresses the root problem of electrical strength weakening due to a pressure drop within loadbreak connector 10. Moreover, cuff venting tool 50 can be immediately utilized with in-service separable loadbreak connectors, thus eliminating lengthy delays that would otherwise be required to replace or retro-fit such connectors in accordance with the above-described prior art approaches. Further, the expense of providing each operator in an electric utility with an easily-used, easily-manufactured cuff venting tool in accordance with the invention is expected to be considerably less than the expense of replacing or retrofitting a significant number of connectors in accordance with the prior art, as would otherwise be required to address the flash-over problem. Cuff venting tool 50 additionally allows loadbreak connector 10 to function while energized in the ambient environment, as it was intended to do, thus minimizing operator and outage times. Cuff venting tool 50 can also be used to free up stuck loadbreak connectors, thus reducing the hotstick pulling force required to separate such connectors and thereby decreasing the possibility of operator injury and component damage.

Figure 11:
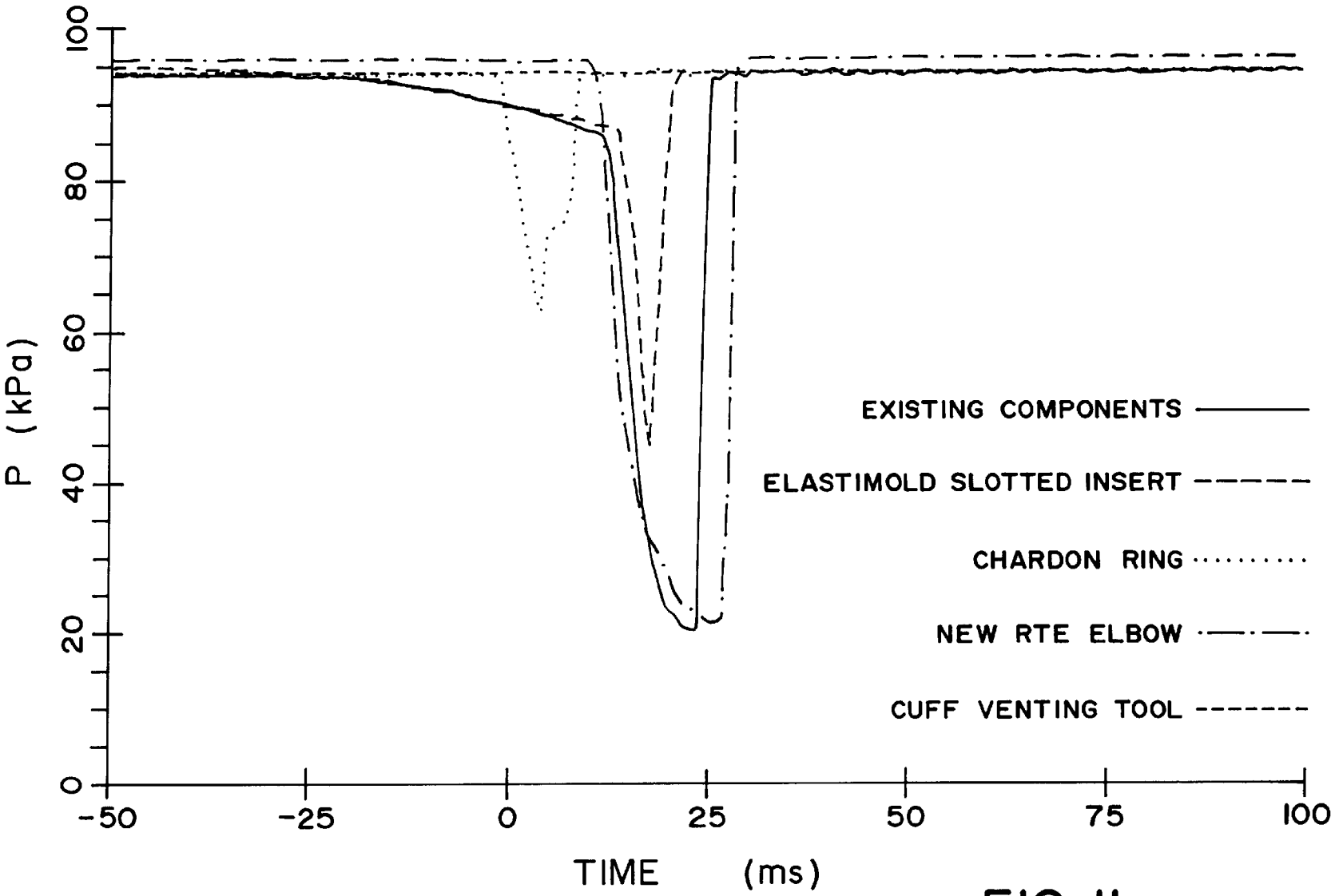
FIG. 11 graphically compares pressure transients (pressure in kilo Pascals vs. time in milliseconds) observed during separation of various prior art loadbreak connectors and during usage of a cuff venting tool in accordance with the invention.

Test results indicate that cuff venting tool 50 is more effective in reducing a partial vacuum in the cuff area than the above-described prior art approaches. Since the primary purpose of tool 50 is to reduce the partial vacuum created in the cuff area of a separable loadbreak connector, the transient pressure in this area was measured during pulling (de-energized opening) operations. An electronic pressure transducer (Motorola MPX Series) was inserted into a small hole in the cuff of an elbow. The transducer's output signal was recorded by a computer equipped with an analog-to-digital data acquisition system set to sample once every millisecond. For purposes of comparison, measurements were recorded on (i) "existing components" (i.e. prior art non-vented Elastimold™ or RTE™ type elbow and cap components), (ii) an "Elastimold™ slotted insert" type loadbreak connector of the type described above in relation to U.S. Pat. No. 5,957,712 Stepniak, (iii) a "Chardon ring" equipped loadbreak connector (i.e. with a ported ring encircling the cuff entry), (iv) a "new RTE elbow" type loadbreak connector as described above in relation to the Muench et al., Muench, Jr. et al. and/or Makal et al. patents, and (v) the aforementioned "existing components" in conjuction with a cuff venting tool constructed and operated as previously described. Typical measurement data for each of the aforementioned cases (i) through (v) are shown in FIG. 11. Significant pressure drops are observed in each of cases (i), (ii), (iii) and (iv); whereas case (v) exhibits substantially no pressure drop. Similar results were observed when various makes and models of elbow and cap components obtained from different manufacturers were substituted for the aforementioned "existing components"; and, when different styles of hotsticks were utilized.

Cuff venting tool 50 was also observed to substantially eliminate the pressure drop when used in conjunction with either of the aforemetioned "Elastimold™ slotted insert" or "new RTE elbow" type loadbreak connectors. The rearward tips of wedges 68, 70 are preferably slightly rounded to enable them to slip freely over the small ridge (about 0.010") presented by the material which forms the slotted region on the "Elastimold™ slotted insert" type loadbreak connector. Alternatively, a tool having sharp-tipped wedges 68, 70 can be initially positioned at an angle relative to the ridge, then manipulated to manoeuver the wedges past the ridge. The ring portion of the "Chardon ring" equipped loadbreak connector was observed to protrude about 0.060" outwardly, preventing cuff venting tool 50 from being slipped under the cuff and over the ring. However, cuff venting tool 50 can still be used effectively with a "Chardon ring" equipped loadbreak connector, although the tool may may pull the ring off.

High voltage tests indicate that cuff venting tool 50 does not lower the sparking voltage of an elbow in open air, even when head 54 bridges the high voltage gap between probe 30 and cuff 44. However, as in the case of any high voltage insulation, at some point, sufficient contamination and/or moisture may accumulate to initiate a spark. It is accordingly strongly recommended that operating procedures be enforced to require that cuff venting tool 50 be kept clean and dry. The tool should be stored in a hotstick bag. If head 54 is damaged or contaminated beyond repair, it can easily be replaced in the field by the operator if a spare is available.

Figure 12:
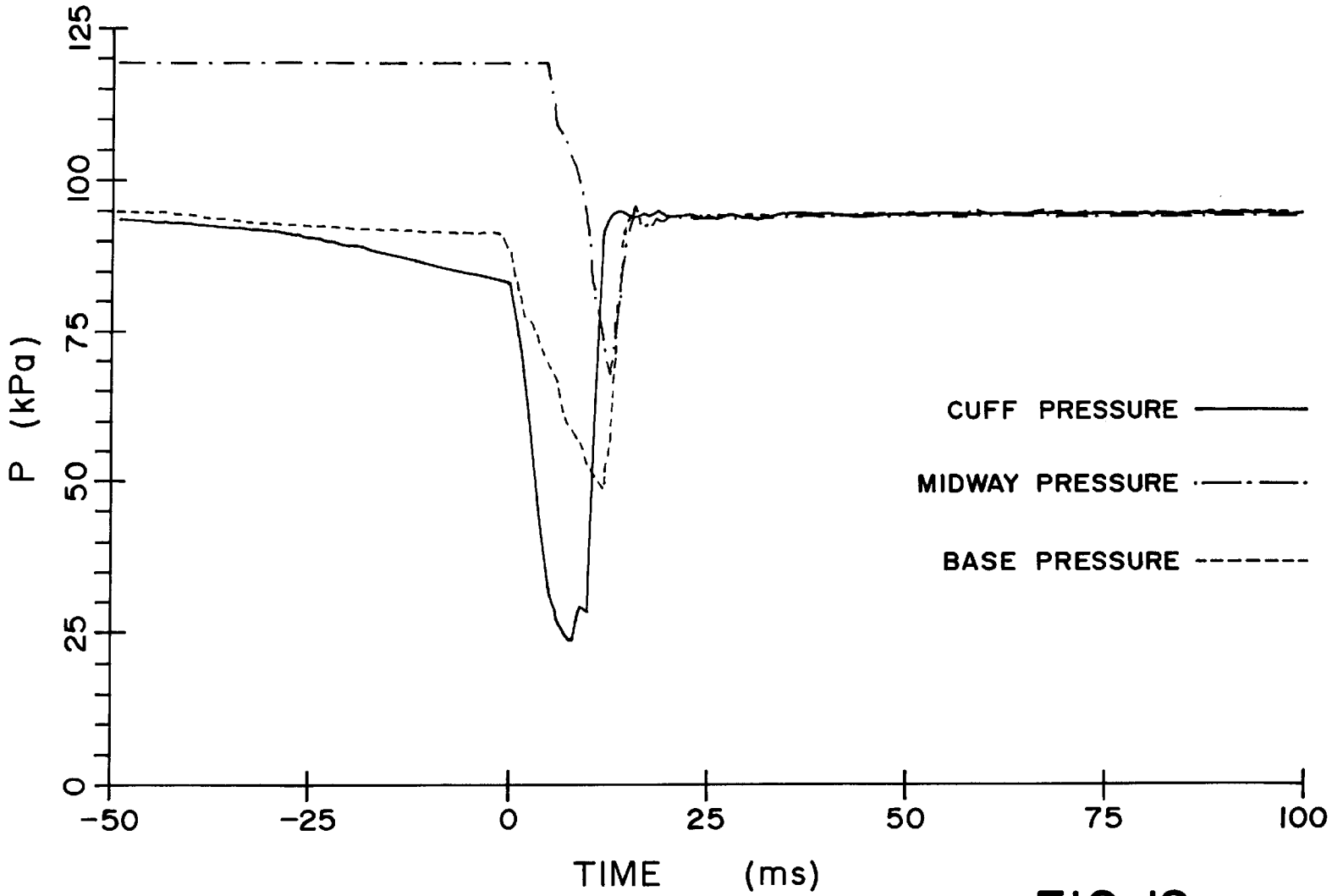
FIG. 12 graphically compares pressure transients observed within the cuff, within the base of the connector, and within the conical surface there-between during separation of a prior art loadbreak connector.
Figure 13:
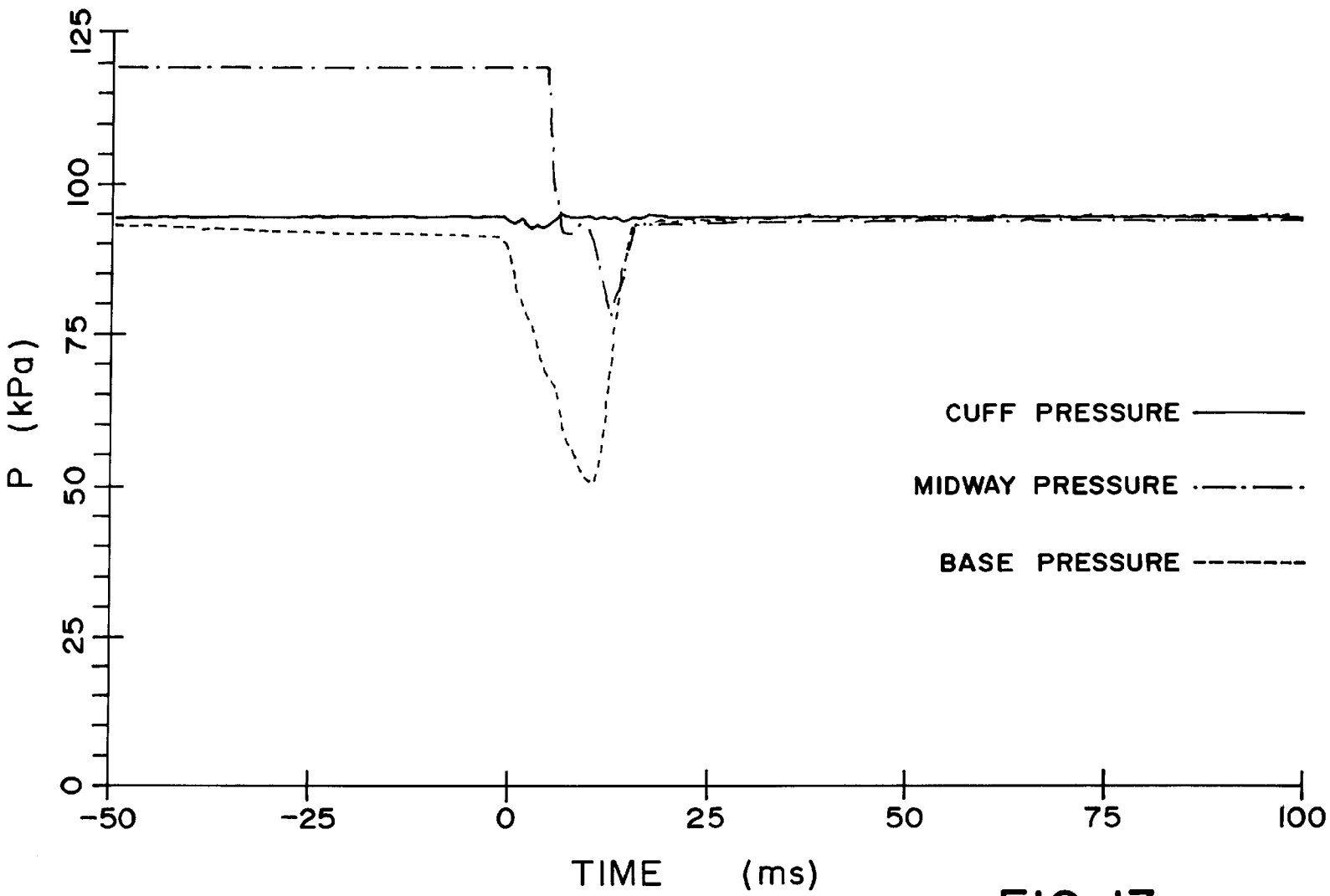
FIG. 13 graphically compares pressure transients observed within the cuff, within the base of the connector, and within the conical surface there-between during separation of a prior art loadbreak connector while venting the cuff with a cuff venting tool in accordance with the invention.

Although test results indicate that cuff venting tool 50 is effective in reducing partial vacua in the cuff area, it is unclear whether venting the cuff eliminates all possibility of flashover. Three regions within loadbreak connector elbow 16 are believed to be subject to partial vacua, namely the "cuff" region, the rearward (i.e. rightward, as viewed in FIG. 1) "base" region within aperture 42, and the "midway" operating interface region between tapered portion 40 of bushing insert 18 and the mating tapered aperture 42 in elbow portion 16. Flashover is known to occur along the operating interface and must originate in either or both of the other regions. FIG. 12 shows typical pressure drops measured in the each of the three aforementioned regions of a prior art loadbreak connector. Clearly, the cuff region experiences the largest pressure drop, and others have indeed suggested that flashover originates in the cuff. If this is correct, then one may reasonably infer that venting the cuff should reduce the likelihood of flashover. Conversely, one may also infer that venting the cuff should not exacerbate the flashover problem. However, venting the cuff has little effect on the pressure drops in the other two regions, as shown in FIG. 13. It is inappropriate to extrapolate the results depicted in FIGS. 12 and 13 so as to formulate a conclusion that venting the cuff eliminates all possibility of flashover, due to the fact that it is very difficult to produce flash-overs under controlled laboratory conditions at normal operating voltages in order to study the problem. Even in field operations, flashovers occur no more than one-half of one percent of the time (i.e. no more than one flashover occurs for every 200 loadbreak connector separation events). Nevertheless, cuff venting tool 50 has produced practical, useful results as previously described.

As will be apparent to those skilled in the art in the light of the foregoing disclosure, many alterations and modifications are possible in the practice of this invention without departing from the spirit or scope thereof. For example, cuff venting tool 50 could be formed as an integral part of a hotstick, instead of being separate therefrom. As another example, although clamp 56 and pivot fulcrum 58 are desirably provided, neither clamp 56 nor pivot fulcrum 58 are essential. If clamp 56 is excluded, the operator must hold cuff venting tool 50 in position on loadbreak connector 10 while manipulating hotstick 82, which could be somewhat awkward. Similarly, if pivot fulcrum 58 is excluded, disengagement of cuff venting tool 50 from hotstick 82 may be somewhat awkward. As a further example, instead of wedges 68, 70 one may alternatively form finger, prong or other rearwardly projecting members on edge 64. If the distance between external housing 48 and cuff 44 is restricted, i.e., comparable to the thickness of head 54 (as is the case if the female mating piece of connector 10 is a parking stand), it is advantageous to give wedges 68, 70 rearward concave curvature (not shown) to facilitate slidable insertion of wedges 68, 70 beneath cuff 44. Although opposed pairs (or more than two) of such wedge, finger, prong or other members are preferably provided, a single such member is sufficient. One or more openings (not shown) can be provided in head 54 and/or head 54 may be formed of a transparent material to allow the operator to see past the end of cuff venting tool 50 if the tool is to be used to move loadbreak connector 10 to an alternative location such as a parking stand. Cuff venting tool 50 can be fabricated as an integral whole rather than constructing it from separate pieces as previously described; or, two or more of the pieces may be fabricated as one integral piece. For example, clamp 56 and pivot fulcrum 58 may be fabricated as one piece. Alternatively, head 54 and/or clamp 56 and/or pivot fulcrum 58 may be fabricated integrally with handle 52, etc. The scope of the invention is to be construed in accordance with the substance defined by the following claims.

What is claimed is:

1. A separable loadbreak connector cuff venting tool, comprising:

(a) a handle formed of an electrical insulator material;

(b) a head fixed on a forward end of said handle, said head formed of an electrical insulator material, said head sized and shaped for mating engagement of said head with a cuff portion of said separable loadbreak connector whereby a force applied along a longitudinal axis of said handle gradually slides said head within said cuff portion thereby venting partial vacua within said cuff portion to the atmosphere surrounding said separable loadbreak connector, said head further comprising a rearwardly projecting member sized and shaped for slidable insertion of said member within said cuff;

(c) a clamp on a rearward portion of said cuff venting tool handle for clamping said cuff venting tool handle to a hotstick handle; and, (d) a pivot fulcrum on said rearward portion of said cuff venting tool handle for unclamping said cuff venting tool handle from said hotstick handle by pivoting said cuff venting tool handle about said pivot fulcrum while forcing said pivot fulcrum against said hotstick handle.

2. A cuff venting tool as defined in claim 1, wherein said head, said clamp and said pivot fulcrum extend transversely and in a single direction away from said cuff venting tool handle.

3. A separable loadbreak connector cuff venting tool, comprising:

(a) a handle formed of an electrical insulator material;

(b) a head fixed on a forward end of said handle, said head formed of an electrical insulator material, said head sized and shaped for mating engagement of said head with a cuff portion of said separable loadbreak connector whereby a force applied along a longitudinal axis of said handle gradually slides said head within said cuff portion thereby venting partial vacua within said cuff portion to the atmosphere surrounding said separable loadbreak connector, said head further comprising:

(i) opposed first and second rearwardly projecting wedges sized and shaped for slidable insertion of said wedges within said cuff; and, (ii) an arcuate forwardly recessed lip having a lower circumferential edge;

wherein said first and second wedges are arcuate and are formed along opposed outward ends of said edge.

4. A cuff venting tool as defined in claim 3, further comprising an arcuate shoulder forming an upper circumferential edge of said lip.

5. A separable loadbreak connector cuff venting tool, comprising:

(a) a handle formed of an electrical insulator material;

(b) a head fixed on a forward end of said handle, said head formed of an electrical insulator material, said head sized and shaped for mating engagement of said head with a cuff portion of said separable loadbreak connector whereby a force applied along a longitudinal axis of said handle gradually slides said head within said cuff portion thereby venting partial vacua within said cuff portion to the atmosphere surrounding said separable loadbreak connector, said head further comprising opposed first and second rearwardly projecting wedges sized and shaped for slidable insertion of said wedges within said cuff;

(c) a clamp on said cuff venting tool handle for clamping said cuff venting tool handle to a hotstick handle; and, (d) a pivot fulcrum on said rearward portion of said cuff venting tool handle for unclamping said cuff venting tool handle from said hotstick handle by pivoting said cuff venting tool handle about said pivot fulcrum while forcing said pivot fulcrum against said hotstick handle.

6. A cuff venting tool as defined in claim 5, wherein said head, said clamp and said pivot fulcrum extend transversely in a single direction away from said cuff venting tool.

7. A method of venting a cuff portion of a loadbreak connector during separation of said connector, said method comprising:

(a) sizing and shaping an electrically insulating member for slidable mating engagement of said member with said cuff portion;

(b) fixing said member on a forward end of an electrically insulating handle;

(c) manipulating said handle to align said member in front of said cuff portion;

(d) drawing said handle rearwardly to slidably insert said member within said cuff portion.

8. A method as defined in claim 7, further comprising rearwardly tapering said member.

9. A method as defined in claim 7, further comprising inwardly and rearwardly concavely curving said member.

10. A method as defined in claim 7, further comprising clamping said handle to a hotstick handle after said inserting of said member within said cuff portion.

* * * * *

UNITED STATES PATENT AND TRADEMARK OFFICE

CERTIFICATE OF CORRECTION

PATENT NO. : 6,453,776 B1
DATED : September 24, 2002
INVENTOR(S) : Beattie et al.

It is certified that error appears in the above-identified patent and that said Letters Patent is hereby corrected as shown below:

Column 3,
Line 52, change “reheating” to -- preheating --
Lines 53-54, change “reheating” to -- preheating --

Column 8,
Line 13, remove the bold highlight from “200”

Signed and Sealed this

Eighteenth Day of February, 2003

JAMES E. ROGAN
*Director of the United States Patent and Trademark Office*